US012760956B2

(12) United States Patent
Bolek et al.

(10) Patent No.: US 12,760,956 B2
(45) **Date of Patent: *Oct. 13, 2026**

(54) CONDENSATION MITIGATION METHOD FOR A REFRIGERATOR APPLIANCE

(71) Applicant: Haier US Appliance Solutions, Inc., Wilmington, DE (US)

(72) Inventors: Slawomir Pawel Bolek, Goshen, KY (US); David L. Gantt, Jr., Decatur, AL (US); Joseph Thomas Waugh, Louisville, KY (US); Saravanan Rajamanickam, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 154 days.

This patent is subject to a terminal disclaimer.

(21) Appl. No.: 18/737,263

(22) Filed: Jun. 7, 2024

(65) Prior Publication Data

US 2025/0377150 A1 Dec. 11, 2025

(51) Int. Cl.
*F25D 21/02* (2006.01)
*F25D 29/00* (2006.01)

(52) U.S. Cl.
CPC ..... *F25D 21/02* (2013.01); *F25D 29/003* (2013.01)

(58) Field of Classification Search
CPC ..... F25D 21/02; F25D 29/003
See application file for complete search history.

(56) References Cited

U.S. PATENT DOCUMENTS 7,913,500 B2 3/2011 Lim et al.
10,190,813 B2 1/2019 Chung et al.
10,969,163 B2 4/2021 Lu et al.
11,226,145 B2 1/2022 Seong et al.
11,629,909 B2 4/2023 Han et al.
2014/0208783 A1 7/2014 Lee et al.
2014/0216706 A1 8/2014 Melton et al.
2019/0264976 A1* 8/2019 Kim ..... F25D 29/005
2020/0224955 A1 7/2020 Park et al.
(Continued)

FOREIGN PATENT DOCUMENTS

JP H06159904 A * 6/1994
WO WO2020121404 A1 6/2020

OTHER PUBLICATIONS

Ryozo, Low Temperature Showcase, Jun. 7, 1994, JPH06159904A, Whole Document (Year: 1994).*

*Primary Examiner* — Larry L Furdge
(74) *Attorney, Agent, or Firm* — Dority & Manning, P.A.

(57) ABSTRACT

A refrigerator appliance includes a cabinet defining a chilled chamber, a sealed system for regulating a chamber temperature within the chilled chamber, and an ambient humidity sensor. A controller is configured to operate the sealed system to regulate the chamber temperature to a standard operating temperature, obtain an ambient humidity using the ambient humidity sensor, determine, based on the ambient humidity, that maintaining the chilled chamber at the standard operating temperature will produce sweat on an outer surface of the refrigerator appliance, determine a target temperature higher than the standard operating temperature that prevents the sweat from being produced on the outer surface of the refrigerator appliance, and operate the sealed system to regulate the chamber temperature to the target temperature.

20 Claims, 4 Drawing Sheets

(56) References Cited

U.S. PATENT DOCUMENTS

| | | | | |
|---|---|---|---|---|
| 2021/0190407 | A1* | 6/2021 | Je | F24F 11/65 |
| 2022/0357091 | A1 | 11/2022 | Duparc et al. | |
| 2023/0043230 | A1 | 2/2023 | Cho et al. | |
| 2024/0318863 | A1* | 9/2024 | Stewart | F24F 11/30 |

* cited by examiner

CONDENSATION MITIGATION METHOD FOR A REFRIGERATOR APPLIANCE

FIELD OF THE INVENTION

The present subject matter relates generally to refrigerator appliances, and more particularly to a refrigerator appliance and methods of operating the same to reduce condensation on outside surfaces of the refrigerator.

BACKGROUND OF THE INVENTION

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include ice making assemblies mounted within an icebox on one of the doors or in a freezer compartment. The ice is stored in a storage bin and is accessible from within the freezer chamber or may be discharged through a dispenser recess defined on a front of the refrigerator door.

Consumers of refrigerator appliances commonly desire a large internal capacity of the refrigerator units. However, due to the fixed external dimensions determined by kitchen cutouts, maximizing the internal capacity becomes challenging. Moreover, consumers expect units to generate no condensation on the outside of the unit in various ambient conditions, and a minimum insulation thickness may be needed to prevent such condensation. While materials with lower thermal conductivity may be used, such as vacuum insulated panels and advanced blown in insulation such as Solstice or Graphene-Based Foams, space limitations may still limit the levels of thermal insulations that are attainable. Other options for mitigating condensation include employing an electrical heater, introducing thermal shunts, or routing a refrigerant hot gas loop in the area, but these methods are often complex, costly, energy-intensive, and/or ineffective.

Accordingly, a refrigerator appliance that addresses one or more of the above issues would be desirable. More particularly, a refrigerator appliance and methods of operating the same to reduce or eliminate the formation of condensate on external surfaces would be particularly beneficial.

BRIEF DESCRIPTION OF THE INVENTION

Aspects and advantages of the invention will be set forth in part in the following description, may be apparent from the description, or may be learned through practice of the invention.

In one exemplary embodiment, a refrigerator appliance defining a vertical direction, a lateral direction, and a transverse direction is provided, including a cabinet defining a chilled chamber, a sealed system for regulating a chamber temperature within the chilled chamber, an ambient humidity sensor, and a controller in operative communication with the sealed system and the ambient humidity sensor. The controller is configured to operate the sealed system to regulate the chamber temperature to a standard operating temperature, obtain an ambient humidity using the ambient humidity sensor, determine, based on the ambient humidity, that maintaining the chilled chamber at the standard operating temperature will produce sweat on an outer surface of the refrigerator appliance, determine a target temperature higher than the standard operating temperature that prevents the sweat from being produced on the outer surface of the refrigerator appliance, and operate the sealed system to regulate the chamber temperature to the target temperature.

In another exemplary embodiment, a method of operating a refrigerator appliance is provided. The refrigerator appliance includes a sealed system for regulating a chamber temperature within a chilled chamber and an ambient humidity sensor. The method includes operating the sealed system to regulate the chamber temperature to a standard operating temperature, obtaining an ambient humidity using the ambient humidity sensor, determining, based on the ambient humidity, that maintaining the chilled chamber at the standard operating temperature will produce sweat on an outer surface of the refrigerator appliance, determining a target temperature higher than the standard operating temperature that prevents the sweat from being produced on the outer surface of the refrigerator appliance, and operating the sealed system to regulate the chamber temperature to the target temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
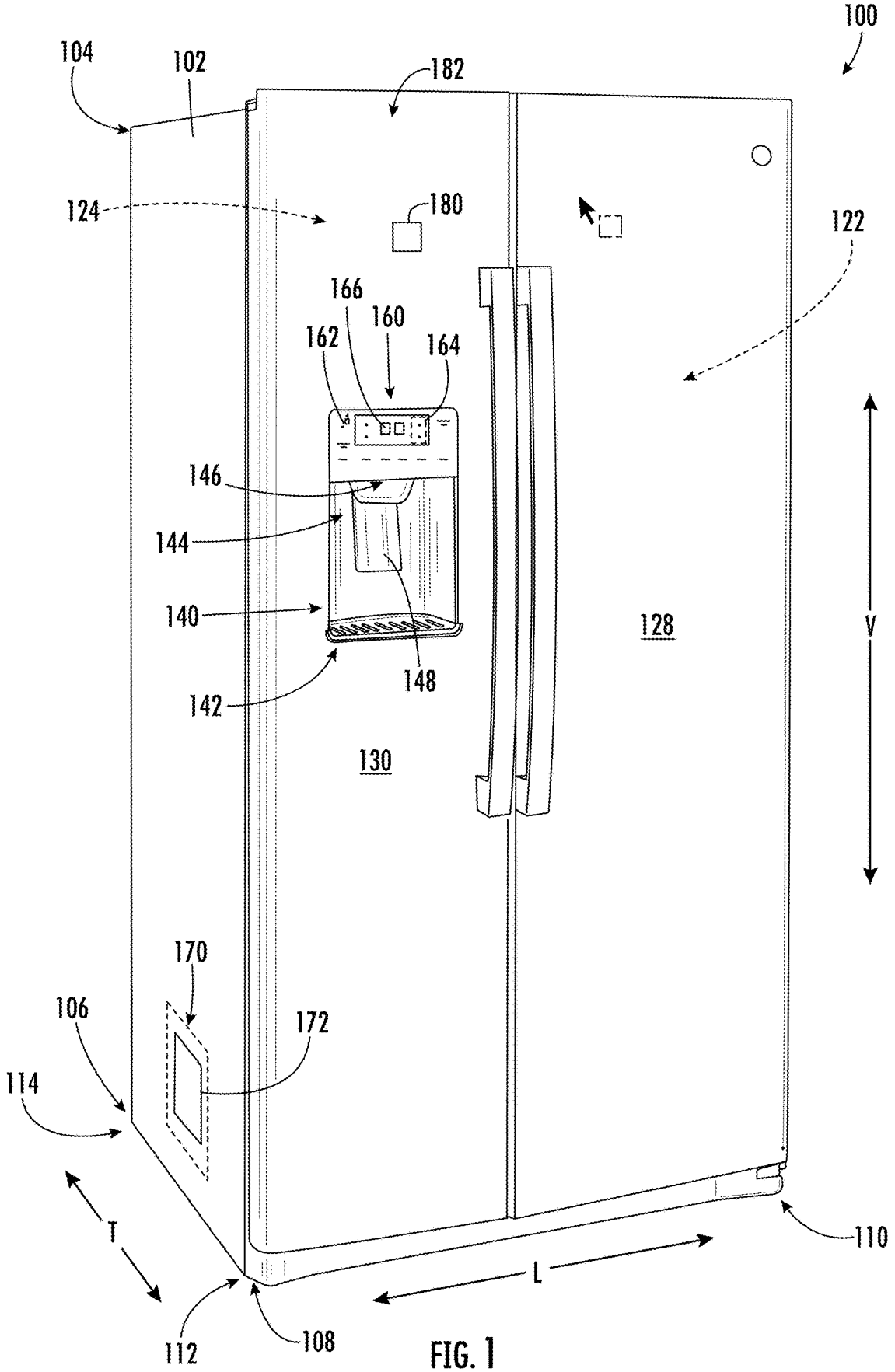
FIG. 1 provides a perspective view of a refrigerator appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent second side 110 of housing 102 and a freezer chamber 124 arranged at or adjacent first side 108 of housing 102. As such, refrigerator appliance 100 is generally referred to as a side-by-side refrigerator. It is recognized, however, that the benefits of the present disclosure apply to other types and styles of refrigerator appliances such as, e.g., a top mount refrigerator appliance, a bottom mount refrigerator appliance, or a single door refrigerator appliance. Consequently, the description set forth herein is for illustrative purposes only and is not intended to be limiting in any aspect to any particular refrigerator chamber configuration.

A refrigerator door 128 is rotatably hinged to an edge of housing 102 for selectively accessing fresh food chamber 122. In addition, a freezer door 130 is rotatably hinged to an edge of housing 102 for selectively accessing freezer chamber 124. Refrigerator door 128 and freezer door 130 are shown in the closed configuration in FIG. 1. One skilled in the art will appreciate that other chamber and door configurations are possible and within the scope of the present invention.

Figure 2:
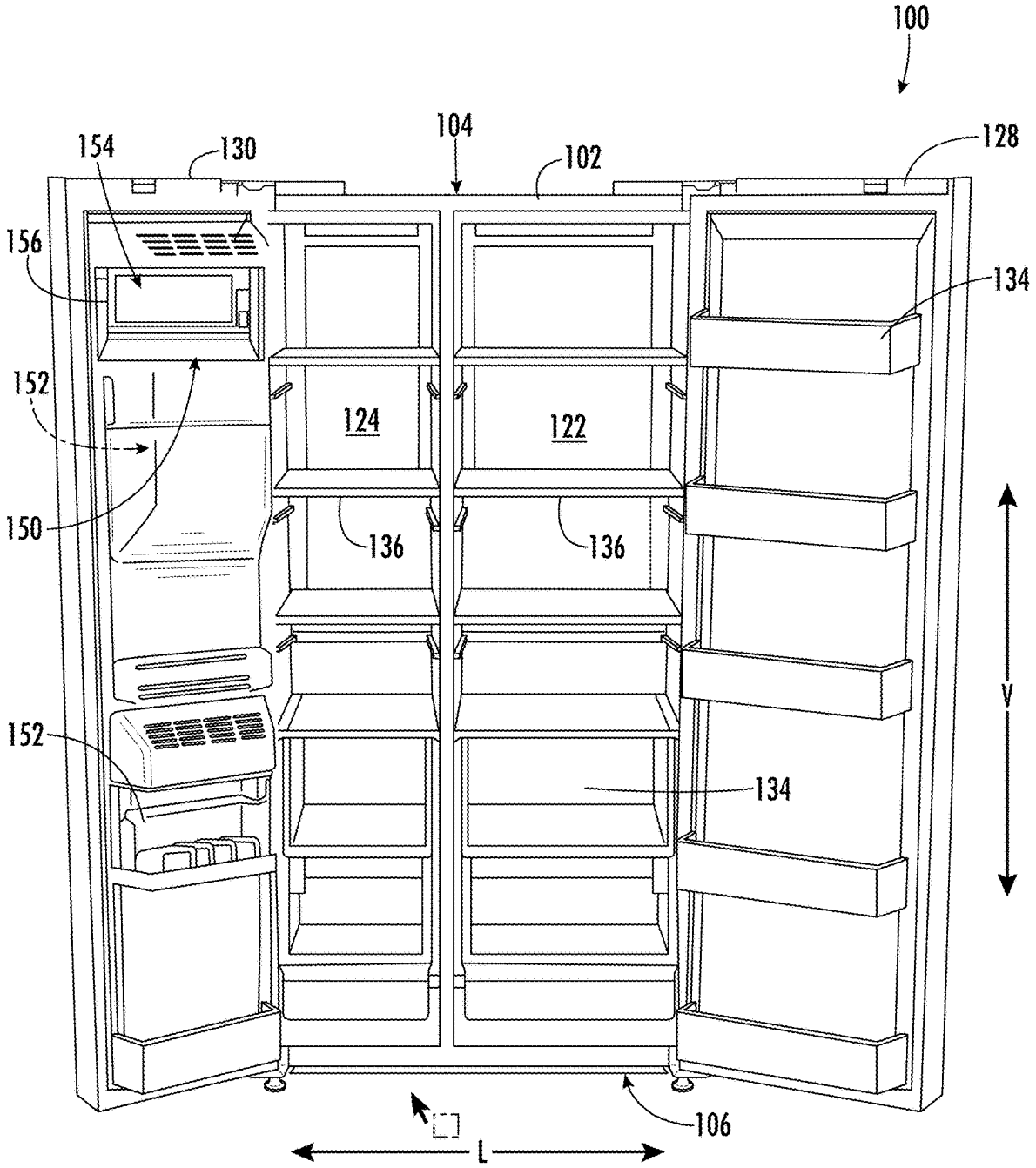
FIG. 2 provides a front view of the example refrigerator appliance of FIG. 1, with the doors of the fresh food chamber and freezer chamber shown in an open position.

FIG. 2 provides a front view of refrigerator appliance 100 shown with refrigerator door 128 and freezer door 130 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator door 128 and freezer door 130 or may slide into a receiving space in fresh food chamber 122 or freezer chamber 124. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on freezer door 130. In this regard, dispenser recess 142 is defined on a front side 112 of refrigerator appliance 100 such that a user may operate dispensing assembly 140 without opening freezer door 130. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

Referring again to FIG. 2, inside refrigerator appliance 100, freezer door 130 may define an icebox 150 housing one or more icemakers and ice storage bins 152 that are configured to form ice. In this regard, for example, icebox 150 may define an ice making chamber 154 for housing ice making assemblies, storage mechanisms, and dispensing mechanisms. According to the illustrated embodiment, icebox 150 may include dispensing assembly 140 and may have a main icemaker 156. In addition, icebox 150 may include an icemaker for forming "craft ice" that is commonly large, clear cubes or spheres of ice for alcoholic or non-alcoholic drinks. For example, a user may access this craft ice by opening freezer door 130 and accessing storage bin 152 directly.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164 and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring again briefly to FIG. 1, according to an exemplary embodiment, cabinet 102 also defines a mechanical compartment 170 at or near the bottom 106 of the cabinet 102 for receipt of a hermetically sealed cooling system 172. In general, sealed cooling system 172 is configured for transporting heat from the inside of refrigerator appliance 100 to the outside (e.g., by executing a vapor-compression cycle or another suitable refrigeration cycle). As is generally understood by those of skill in the art, the hermetically sealed system 172 contains a working fluid, e.g., refrigerant, which flows between various heat exchangers of the sealed system 172 where the working fluid changes phases while transferring thermal energy.

In this regard, as understood by one having ordinary skill in the art, sealed system 172 may include a compressor, a condenser, an expansion device, and one or more evaporators connected in series by a fluid conduit that is charged with a refrigerant. Within sealed system 172, refrigerant flows into the compressor, which operates to increase the pressure of the refrigerant. This compression of the refrigerant raises its temperature, which is lowered by passing the refrigerant through the condenser. Within the condenser, heat exchange with ambient air takes place so as to cool the refrigerant. A condenser fan may be used to pull air across the condenser, so as to provide forced convection for a more rapid and efficient heat exchange between the refrigerant within the condenser and the ambient air. Thus, as will be understood by those skilled in the art, increasing air flow across the condenser can, e.g., increase the efficiency of the condenser by improving cooling of the refrigerant contained therein.

An expansion device (e.g., an electronic expansion valve, capillary tube, or other restriction device) receives refrigerant from the condenser. From the expansion device, the refrigerant enters the evaporator. Upon exiting the expansion device and entering the evaporator, the refrigerant drops in pressure. Due to the pressure drop and/or phase change of the refrigerant, the evaporator is relatively cool. An evaporator fan is typically provided at each the evaporator, e.g., to force air across and around the at least one evaporator to transfer thermal energy from the air to the evaporator (and more particularly, to the working fluid or refrigerant therein).

In this manner, a flow of cooling air exits the evaporator and may be distributed to one or more of the chilled chambers 122 and/or 124. Specifically, one or more ducts may extend between the mechanical compartment 170 and the chilled chambers 122 and/or 124 to provide fluid communication therebetween, e.g., to provide the chilled air from the hermetically sealed cooling system 172, e.g., from an evaporator thereof, to one or more of the chilled chambers 122 and/or 124.

The sealed system 172 described herein is provided by way of example only. Thus, it is within the scope of the present subject matter for other configurations of the refrigeration system to be used as well. For example, according to alternative embodiments, sealed system 172 may include additional components, e.g., at least one additional evaporator, compressor, expansion device, and/or condenser. For example, refrigerator appliance 100 may have two or more split evaporators, e.g., one dedicated primarily to cooling fresh food chamber 122 and one dedicated primarily to cooling freezer chamber 124. In addition, alternative plumbing configurations, valves, and flow regulators may be used to route refrigerant throughout sealed system 172.

As shown in FIG. 1, refrigerator appliance 100 may further include one or more temperature and humidity sensors to facilitate improved operation of refrigerator appliance 100 and icemaker 156. For example, a temperature and/or humidity sensor 180 may be mounted to an outer surface 182 of refrigerator appliance 100, e.g., for measuring an ambient temperature and/or humidity of the environment surrounding refrigerator appliance. As used herein, "temperature sensor" or the equivalent is intended to refer to any suitable type of temperature measuring system or device positioned at any suitable location for measuring the desired temperature. Thus, for example, temperature sensor 180 may each be any suitable type of temperature sensor, such as a thermistor, a thermocouple, a resistance temperature detector, a semiconductor-based integrated circuit temperature sensor, etc. As used herein, the terms "humidity sensor" or the equivalent may be intended to refer to any suitable type of humidity measuring system or device positioned at any suitable location for measuring the desired humidity. Thus, for example, "humidity sensor" may refer to any suitable type of humidity sensor, such as capacitive digital sensors, resistive sensors, and thermal conductivity humidity sensors. In addition, the temperature and/or humidity sensor 180 may be positioned at any suitable location and may output a signal, such as a voltage, to a controller that is proportional to and/or indicative of the humidity being measured. Although exemplary positioning of temperature and/or humidity sensor 180 is described herein, it should be appreciated that refrigerator appliance 100 may include any other suitable number, type, and position of temperature/humidity sensors according to alternative embodiments. In addition, it should be appreciated that these may be separate sensors mounted at different locations.

Now that the construction and configuration of refrigerator appliance 100 has been presented according to an exemplary embodiment of the present subject matter, an exemplary method 200 for operating a refrigerator appliance 100 is provided. Method 200 can be used to operate refrigerator appliance 100, or to operate any other suitable refrigerator. In this regard, for example, controller 164 may be configured for implementing method 200. However, it should be appreciated that the exemplary method 200 is discussed herein only to describe exemplary aspects of the present subject matter, and is not intended to be limiting.

Figure 3:
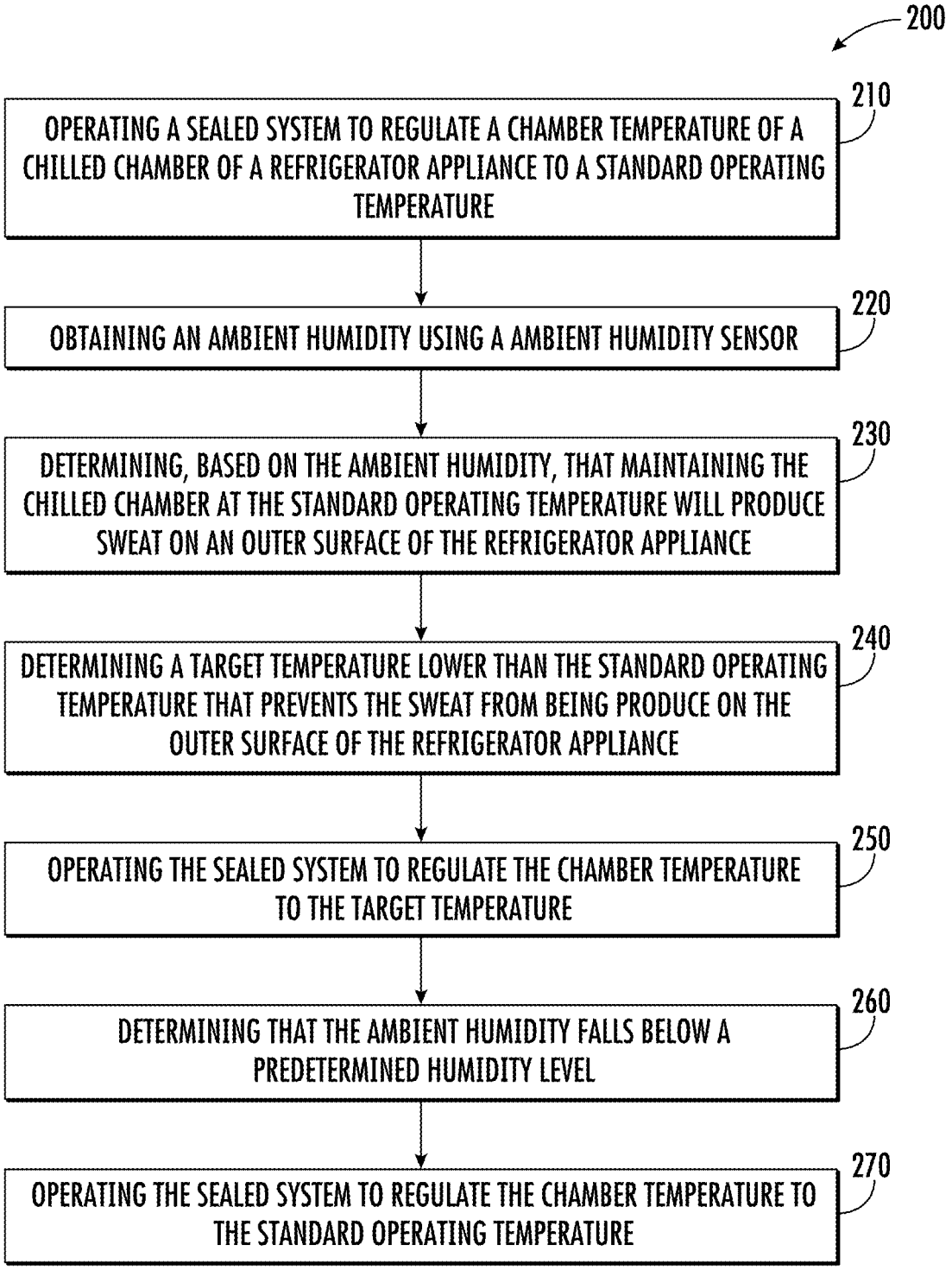
FIG. 3 provides a method of operating a refrigerator appliance according to an example embodiment of the present subject matter.

As shown in FIG. 3, method 200 includes, at step 210, operating the sealed system to regulate a chamber temperature of a chilled chamber of a refrigerator appliance to a standard operating temperature. In this regard, continuing the example from above, controller 164 may operate sealed system 172 to regulate the temperature of fresh food chamber 122 and/or freezer chamber 124. As used herein, the term "standard operating temperature" and the like is generally intended to refer to the standard, normal, default, or preprogrammed operating temperature of refrigerator appliance 100. For example, the standard operating temperature may be set by the manufacturer, adjusted by a user (e.g., via control panel 160), or determined in any other suitable manner. In addition, the standard operating temperature may generally be the desired setpoint temperature without regard to the ambient humidity and concerns over condensation.

Step 220 may generally include obtaining an ambient humidity using an ambient humidity sensor. In this regard, the temperature and/or humidity sensor 180 may be used to obtain the relative ambient humidity of an environment surrounding refrigerator appliance 100. Notably, this ambient humidity may be used to make informed decisions as to how cold the temperatures of chilled chambers 122, 124 may be maintained without producing sweat on exterior surfaces (e.g., such as outer surface 182) of refrigerator appliance 100.

Specifically, step 230 may include determining, based on the ambient humidity, that maintaining the chilled chamber at the standard operating temperature will produce sweat on an outer surface of the refrigerator appliance. In this regard, controller 164 may be programmed to know or be capable of determining an outer surface temperature of refrigerator appliance for any given chamber temperature (e.g., based on parametric testing, insulation values, appliance configurations, etc.). Controller 164 may also be programmed for determining the dewpoint temperature, e.g., based on the ambient humidity (e.g., measured at step 220). In this regard, the dewpoint temperature may be the temperature of air (e.g., assuming relatively constant ambient pressure) at which point the relative humidity reaches or approaches 100%. At this dewpoint temperature, air cannot hold any more water in gas form and may have a tendency to sweat or produce liquid from water vapor within the air. Accordingly, method 200 may use the dewpoint temperature to ensure that the chamber temperature is not decreased to a point where the surfaces of refrigerator appliance 100 reach the dewpoint temperature.

For example, step 230 may include determining that the ambient humidity is equal to or exceeds a relative humidity threshold. In this regard, the relative humidity threshold (e.g., a second humidity threshold or higher threshold) may be preprogrammed into controller 164 and at which condensation is likely to be formed based on the chilled chamber temperature. According to an example embodiment, in order to avoid nuisance tripping of this trigger threshold, the relative humidity threshold may be equal to a predetermined humidity level (e.g., a first humidity threshold or lower threshold) plus a humidity offset value. As explained in more detail below, operation of refrigerator appliance does not return to the standard operating temperature until after the ambient humidity drops below the predetermined humidity level. Accordingly, the target temperatures for chilled chamber are not frequently changed or oscillated using the current control algorithm.

According to example embodiments, the predetermined humidity level may be between about 60% and 90%, between about 70% and 80%, or about 75%. It should be appreciated that other variations in the predetermined humidity levels, the mathematical models relating the target temperature, and the ambient humidity may be used remaining within the scope of the present subject matter. In addition, the humidity offset value may be varied by the user or set by the manufacturer, where a larger humidity offset value defines a larger control band and reduces the likelihood of frequent oscillations in the target temperature. For example, the humidity offset value may be a predetermined percentage of the predetermined humidity level, e.g., such as between about 1% and 10%, between about 3% and 7%, or about 5%.

Notably, according to example embodiments, the ambient temperature may also be used to determine that condensation will likely form. In this regard, method 200 may further include obtaining an ambient temperature using the temperature and/or humidity sensor 180 and the ambient humidity and the ambient temperature may be used to determine that maintaining the chilled chamber at the standard operating temperature will produce sweat on the outer surface of the refrigerator appliance.

Step 240 may generally include determining a target temperature higher than the standard operating temperature that prevents the sweat from being produced on the outer surface of the refrigerator appliance. In this regard, in response to determining at step 230 that standard operating temperatures will produce condensation, step 240 may include increasing the target temperature to avoid condensation. Thus, according to an example embodiment, the target temperature may be a predetermined number of degrees higher than the standard operating temperature, e.g., such as between about 0.5 and 10, between about 1 and 3, or about 2 degrees higher than the standard operating temperature.

According to still other embodiments, the target temperature may be determined as a function of the ambient humidity. In this regard, a relationship between the target temperature and the ambient humidity may be stored within controller 164 in the form of a lookup table, a regression equation, or a mathematical model. In general, a higher ambient humidity may generally merit a higher target temperature to avoid condensation on outer surface 182 of refrigerator appliance 100. In addition, according to an example embodiment, the target temperature may be determined based on both the ambient humidity and the ambient temperature, e.g., as obtained by temperature and/or humidity sensor 180.

Step 250 generally includes operating the sealed system to regulate the chamber temperature to the target temperature. In this regard, controller 164 may regulate sealed system 172 to regulate the chamber temperature of the chilled chamber to the target temperature instead of the standard operating temperature to avoid the formation of condensate on outer surfaces 182.

Notably, in the event that the ambient humidity drops sufficiently to reduce or eliminate the concern of condensation, method 200 may further include returning to the standard operating temperature or the setpoint temperature of chilled chamber. In this regard, method 200 further include, at step 260, determining that the ambient humidity falls below the predetermined humidity level. In the event that the humidity falls below this lower humidity threshold, the target temperature may be adjusted back to the standard operating temperature. More specifically, step 270 may include operating the sealed system to regulate the chamber temperature to the standard operating temperature.

Figure 4:
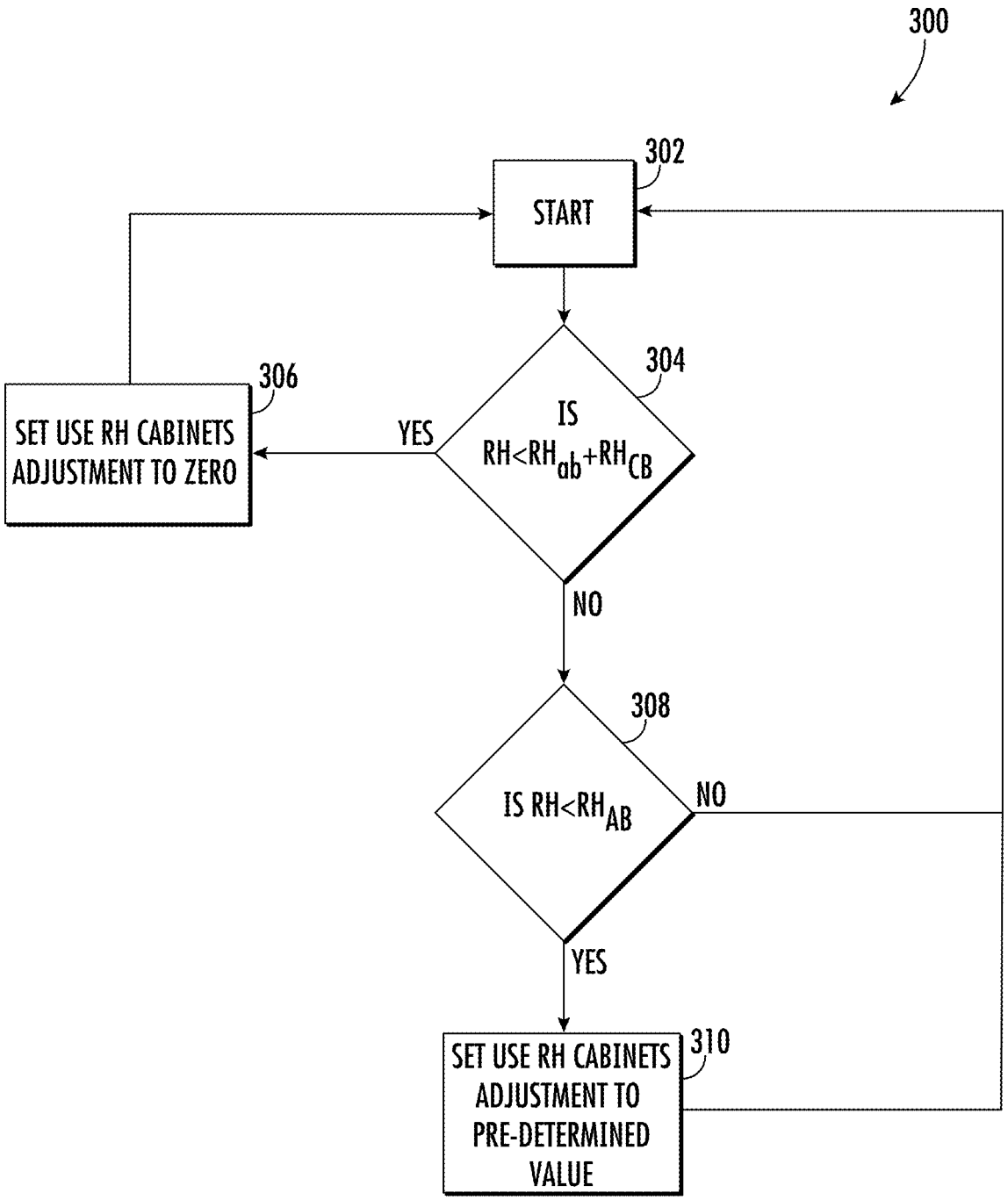
FIG. 4 provides a condensation mitigation algorithm for a refrigerator appliance according to an example embodiment of the present subject matter.

Referring now briefly to FIG. 4, a condensation mitigation algorithm for a refrigerator appliance is provided according to an example embodiment of the present subject matter. In this regard, method 300 may begin at step 302, where the sealed system is operating at a standard operating temperature. Step 304 may include obtaining the ambient relative humidity (RH) and estimating or determining a relative humidity threshold, which may be the sum of a predetermined humidity level ($RH_{ab}$, e.g., associated with an abnormal humidity where condensation becomes likely) plus a humidity offset value ($RH_{cb}$, a control band or offset relative to the predetermined humidity level). Step 304 may further include determining whether the ambient relative humidity (RH) exceeds the relative humidity threshold ($RH_{ab}+RH_{cb}$).

If step 304 results in a determination that the ambient humidity (RH) does not exceed the relative humidity threshold ($RH_{ab}+RH_{cb}$), step 306 may include making zero adjustments to the chilled chamber temperature and maintaining operation at the standard chamber temperature. By contrast, if step 304 results in a determination that the ambient humidity (RH) exceeds the relative humidity threshold ($RH_{ab}+RH_{cb}$), step 308 may include determining whether the ambient humidity (RH) exceeds the predetermined humidity level ($RH_{ab}$). If the ambient humidity (RH) does not exceed the predetermined humidity level ($RH_{ab}$), condensation concerns may be minimal and method 300 may proceed back up to step 306 where operation at the standard operating temperature commences. Notably, this serves to provide hysteresis or debounce in method 300 to prevent nuisance trips or adjustments to the target temperature. If the ambient humidity (RH) remains above the predetermined humidity level ($RH_{ab}$), step 310 may include adjusting a target temperature to the higher target temperature to prevent the formation of condensate FIGS. 3 and 4 depict example control methods having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of these methods are explained using refrigerator appliance 100 as an example, it should be appreciated that these methods may be applied to the operation of any suitable refrigerator.

As explained herein, aspects of the present subject matter are generally directed to a refrigerator appliance and a condensation prevention method to mitigate issues with condensation on an outside surface of the refrigerator. For example, the refrigerator may use a software algorithm that temporarily adjusts the internal cabinet temperature by changing the chamber target temperature or set point with the help of an ambient relative humidity sensor to prevent the condensation outside the unit.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A refrigerator appliance defining a vertical direction, a lateral direction, and a transverse direction, comprising:
- a cabinet defining a chilled chamber;
- a sealed system for regulating a chamber temperature within the chilled chamber;
- an ambient humidity sensor; and
- a controller in operative communication with the sealed system and the ambient humidity sensor, the controller being configured to:
  - operate the sealed system to regulate the chamber temperature to a standard operating temperature;
  - obtain an ambient humidity using the ambient humidity sensor;
  - determine, based on the ambient humidity, that maintaining the chilled chamber at the standard operating temperature will produce sweat on an outer surface of the refrigerator appliance;
  - determine a target temperature higher than the standard operating temperature that prevents the sweat from being produced on the outer surface of the refrigerator appliance; and
  - operate the sealed system to regulate the chamber temperature to the target temperature.

2. The refrigerator appliance of claim 1, wherein determining, based on the ambient humidity, that maintaining the chilled chamber at the standard operating temperature will produce sweat on the outer surface of the refrigerator appliance comprises:
- determining that the ambient humidity is equal to or exceeds a relative humidity threshold.

3. The refrigerator appliance of claim 2, wherein the relative humidity threshold is equal to a predetermined humidity level plus a humidity offset value.

4. The refrigerator appliance of claim 3, wherein the predetermined humidity level is between about 60% and 90%.

5. The refrigerator appliance of claim 4, wherein the predetermined humidity level is about 75%.

6. The refrigerator appliance of claim 3, wherein the humidity offset value is a predetermined percentage of the predetermined humidity level.

7. The refrigerator appliance of claim 6, wherein the predetermined percentage is between about 3% and 7%.

8. The refrigerator appliance of claim 3, wherein the controller is further configured to:

determine that the ambient humidity falls below the predetermined humidity level; and operate the sealed system to regulate the chamber temperature to the standard operating temperature.

9. The refrigerator appliance of claim 1, wherein the target temperature is higher than the standard operating temperature by a predetermined temperature offset.

10. The refrigerator appliance of claim 9, wherein the predetermined temperature offset is between about 0.5 and 10 degrees higher than the standard operating temperature.

11. The refrigerator appliance of claim 9, wherein the predetermined temperature offset is between about 1 and 3 degrees higher than the standard operating temperature.

12. The refrigerator appliance of claim 1, wherein the target temperature is determined as a function of the ambient humidity.

13. The refrigerator appliance of claim 12, wherein a relationship between the target temperature and the ambient humidity is stored in a lookup table, a regression equation, or a mathematical model.

14. The refrigerator appliance of claim 1, further comprising:

an ambient temperature sensor, wherein the controller is in operative communication with the ambient temperature sensor and is further configured to:

obtain an ambient temperature using the ambient temperature sensor;

determine, based on the ambient humidity and the ambient temperature, that maintaining the chilled chamber at the standard operating temperature will produce sweat on the outer surface of the refrigerator appliance;

determine the target temperature higher than the standard operating temperature that prevents the sweat from being produced on the outer surface of the refrigerator appliance; and operate the sealed system to regulate the chamber temperature to the target temperature.

15. The refrigerator appliance of claim 1, wherein the ambient humidity sensor is mounted on the outer surface of the refrigerator appliance.

16. The refrigerator appliance of claim 1, wherein the refrigerator appliance is a side-by-side refrigerator appliance and the chilled chamber is a freezer chamber.

17. A method of operating a refrigerator appliance, the refrigerator appliance comprising a sealed system for regulating a chamber temperature within a chilled chamber and an ambient humidity sensor, the method comprising:

operating the sealed system to regulate the chamber temperature to a standard operating temperature;

obtaining an ambient humidity using the ambient humidity sensor;

determining, based on the ambient humidity, that maintaining the chilled chamber at the standard operating temperature will produce sweat on an outer surface of the refrigerator appliance;

determining a target temperature higher than the standard operating temperature that prevents the sweat from being produced on the outer surface of the refrigerator appliance; and operating the sealed system to regulate the chamber temperature to the target temperature.

18. The method of claim 17, wherein determining, based on the ambient humidity, that maintaining the chilled chamber at the standard operating temperature will produce sweat on the outer surface of the refrigerator appliance comprises:

determining that the ambient humidity is equal to or exceeds a relative humidity threshold.

19. The method of claim 18, wherein the relative humidity threshold is equal to a predetermined humidity level plus a humidity offset value.

20. The method of claim 17, further comprising:

determining that the ambient humidity falls below a predetermined humidity level; and operating the sealed system to regulate the chamber temperature to the standard operating temperature.

* * * * *